US007772817B2

(12) United States Patent
Takagi et al.

(10) Patent No.: US 7,772,817 B2
(45) **Date of Patent: *Aug. 10, 2010**

(54) CONSTANT VOLTAGE CIRCUIT CAPABLE OF QUICKLY RESPONDING TO A SUDDEN CHANGE OF LOAD CURRENT

(75) Inventors: Yoshiki Takagi, Hyougo-ken (JP); Yusuke Minakuchi, Nara (JP)

(73) Assignee: Ricoh Company, Ltd., Tokyo (JP)

( * ) Notice: Subject to any disclaimer, the term of this patent is extended or adjusted under 35 U.S.C. 154(b) by 130 days.

This patent is subject to a terminal disclaimer.

(21) Appl. No.: 12/222,537

(22) Filed: Aug. 11, 2008

(65) Prior Publication Data

US 2009/0015222 A1 Jan. 15, 2009

Related U.S. Application Data

(63) Continuation of application No. 11/395,295, filed on Apr. 3, 2006, now Pat. No. 7,429,852.

(30) Foreign Application Priority Data

Apr. 4, 2005 (JP) ..... 2005-107677

(51) Int. Cl.
*G05F 1/565* (2006.01)

(52) U.S. Cl. ..... 323/280; 323/275

(58) Field of Classification Search ..... 323/280, 323/273, 286, 281, 275, 279, 274, 276–278, 323/282; 327/541

See application file for complete search history.

(56) References Cited

U.S. PATENT DOCUMENTS 6,465,994 B1 10/2002 Xi
6,686,728 B2 2/2004 Nakajima

FOREIGN PATENT DOCUMENTS

JP 7-325455 12/1995
JP 2002-72605 3/2002
JP 2006-277229 10/2006

OTHER PUBLICATIONS

Phillip E. Allen and Douglas R. Holberg, CMOS Analog Circuit Design, Oxford University Press, 1987, pp. 227-239.*

* cited by examiner

*Primary Examiner*—Harry Behm
(74) *Attorney, Agent, or Firm*—Dickstein Shapiro LLP

(57) ABSTRACT

A constant voltage circuit which is capable of quickly responding to a sudden change of an output voltage includes an output transistor, and first and second error amplifiers. The output transistor outputs a power with an output voltage and an output current to a load. The first error amplifier is configured to increase a response speed with respect to changes of the output voltage in accordance with an increase of the output current so as to control operations of the output transistor. The second error amplifier has a response speed faster than the first error amplifier with respect to changes of the output voltage, and is configured to decrease a gain thereof in response to a drain current of the output transistor.

10 Claims, 5 Drawing Sheets

CONSTANT VOLTAGE CIRCUIT CAPABLE OF QUICKLY RESPONDING TO A SUDDEN CHANGE OF LOAD CURRENT

This is a continuation application of U.S. patent application Ser. No. 11/395,295, filed on Apr. 3, 2006, now U.S. Pat. No. 7,429,852, the disclosure of which is incorporated by reference in its entirety.

BACKGROUND OF THE INVENTION

1. Field of the Invention

The present invention relates to a constant voltage circuit, and more particularly to a constant voltage circuit which is capable of quickly responding to a sudden change of a load current.

2. Discussion of the Background

A background constant voltage circuit has a function to rapidly compensate for decreases in an output voltage due to a sudden rise of a load current. In this compensation, the circuit simply detects an alternating current element in the varying output voltage and supplies a compensation current to the load from a power source voltage based on the detection result, thereby compensating a sudden decrease of the output voltage. For this operation, the circuit is provided with a coupling capacitor for the detection and an additional transistor for the compensation current different from an output transistor.

FIG. 1 illustrates a constant voltage circuit 100 as an example of such background constant voltage circuit. The constant voltage circuit 100 of FIG. 1 has an improved responsiveness to a sudden rise of a load current consumed by a load 10. The improvement is achieved by a control of a output transistor M1 to change an output voltage using a second error amplifier AMPb having a fast response speed. This example does not require an additional transistor for the compensation current different from an output transistor.

More details of the constant voltage circuit 100 of FIG. 1 is explained below. As illustrated in FIG. 1, the constant voltage circuit 100 includes a first reference voltage generator (1st RVG) 2, a second reference voltage generator (2nd RVG) 3, and a third reference voltage generator (3rd RVG) 4. The first reference voltage generator 2 generates and outputs a predetermined reference voltage Vr. The second reference voltage generator 3 generates and outputs a predetermined reference voltage Vb1. The third reference voltage generator 4 generates and outputs a predetermined bias voltage Vb2. The constant voltage circuit 100 further includes resistors R1 and R2, a output transistor M1, and an error amplifying circuit 105. The resistors R1 and R2 divide an output voltage Vout to generate a divided voltage VFB. The output transistor M1 includes a P-MOS (P-type metal oxide semiconductor) transistor which, based on an input signal to a gate thereof, controls a current io flowing through an output terminal OUT. The error amplifying circuit 105 controls an operation of the output transistor M1 such that the divided voltage VFB is equalized to the reference voltage Vr.

The error amplifying circuit 105 includes first and second error amplifiers AMPa and AMPb. The first error amplifier AMPa has a non-inverse input terminal to which the reference voltage Vr is input and an inverse input terminal to which the divided voltage VFB is input. The second error amplifier AMPb has a non-inverse input terminal to which the reference voltage Vb1 is input and an inverse input terminal to which the output voltage Vout is input. Each of the first and second error amplifiers AMPa and AMPb outputs a signal for controlling the operation of the output transistor M1 so as to control the output voltage Vout.

The first error amplifier AMPa is configured to have a gain of a direct current as great as possible so as to produce a superior direct current characteristic. More, specifically, in the first error amplifier AMPa, a N-MOS (N-type metal oxide semiconductor) transistor M2 serving as a constant current source generates a drain current as small as possible. On the other hand, the second error amplifier AMPb is configured to amplify only an alternating current element of the output voltage Vout. To make it, in the second error amplifier AMPb, a P-MOS transistor M11 has a gate connected to the output terminal OUT via a capacitor C3 operating as a coupling capacitor.

The first error amplifier AMPa has any particular difference from the one used in a common constant-voltage circuit. Therefore, no further details on the first error amplifier AMPa are explained.

The second error amplifier AMPb has a two-stage amplifying structure, and includes a differential amplifying circuit as a first stage and a N-MOS transistor M14 as a second stage. The differential amplifying circuit includes P-MOS transistors M9, M10, and M11, and N-MOS transistors M12 and M13. The P-MOS transistors M10 and M11 form a differential pair, and one of them is configured to have an offset voltage so that the P-MOS transistor M11 is in an off state when the output voltage Vout is in a stable state. The drain voltage of the P-MOS transistor M11 is therefore 0 volts. As a consequence, the N-MOS transistor M14 is turned off and does not affect the control of the output transistor M1.

When the output voltage Vout is suddenly decreased due to a steep change of the load, for example, it causes the gate voltage of the P-MOS transistor M11 to be decreased via the coupling capacitor C3. The gate voltage of the P-MOS transistor M10 is also decreased but with a slight delay from the decrease of the gate voltage of the P-MOS transistor M11 by an action of the resistor R4. As a result, the P-MOS transistor M11 is turned on and the drain voltage thereof is increased again. Upon a time the drain voltage of the P-MOS transistor M11 exceeds a threshold value of the gate voltage of the N-MOS transistor M14, the N-MOS transistor M14 is turned on and accordingly causes the output transistor M1 to reduce the gate voltage thereof. Consequently, the output transistor M1 is caused to increase the drain current by which the output voltage Vout is increased to the predetermined voltage.

In this configuration, the response speed of the second error amplifier AMPb is faster than that of the first error amplifier AMPa. Therefore, it becomes possible to return the output voltage Vout to the predetermined voltage before the first error amplifier AMPa is activated to compensate a reduction of the output voltage Vout.

On the other hand, when the output voltage Vout is increased, the P-MOS transistor M11 is affected via the coupling capacitor C3 in a way to increase the gate voltage thereof. However, at this time, the P-MOS transistor M11 is held in an off-state and therefore the N-MOS transistor M14 also maintains in an off-state. Accordingly, the control of the output transistor M1 is not affected.

In the constant voltage circuit 100 of FIG. 1, the coupling capacitor C3 may be configured to have a greater capacitance to increase a sensitivity to a change of the output voltage Vout. In this case, however, the gate voltage of the output transistor M1 is excessively lowered particularly at a power-on time, or when the output voltage Vout is largely decreased due to a significant change of the load current. FIG. 2 illustrates a typical overshoot of the output voltage Vout at a recovery to the predetermined voltage after such an excessive reduction of the gate voltage of the output transistor M1. As illustrated in FIG. 1, this overshoot may cause an oscillation when the overshoot voltage is returned to the predetermined voltage. That is, the second error amplifier AMPb is again activated to increase the output voltage Vout.

On the other hand, if the coupling capacitor C3 is configured to have a relatively small capacitance, the above-described overshoot may be avoided. However, the sensitivity to the change of the output voltage Vout is lowered and, as a result, a relatively small change of the output voltage Vout cannot be compensated.

SUMMARY OF THE INVENTION

This patent specification describes a novel constant voltage circuit which is capable of quickly responding to a sudden change of an output voltage. In one example, a novel constant voltage circuit includes an output transistor, and first and second error amplifiers. The output transistor outputs a power with an output voltage and an output current to a load. The first error amplifier is configured to increase a response speed with respect to changes of the output voltage in accordance: with an increase of the output current so as to control operations of the output transistor. The second error amplifier has a response speed faster than the first error amplifier with respect to changes of the output voltage, and is configured to decrease a gain thereof in response to a drain current of the output transistor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
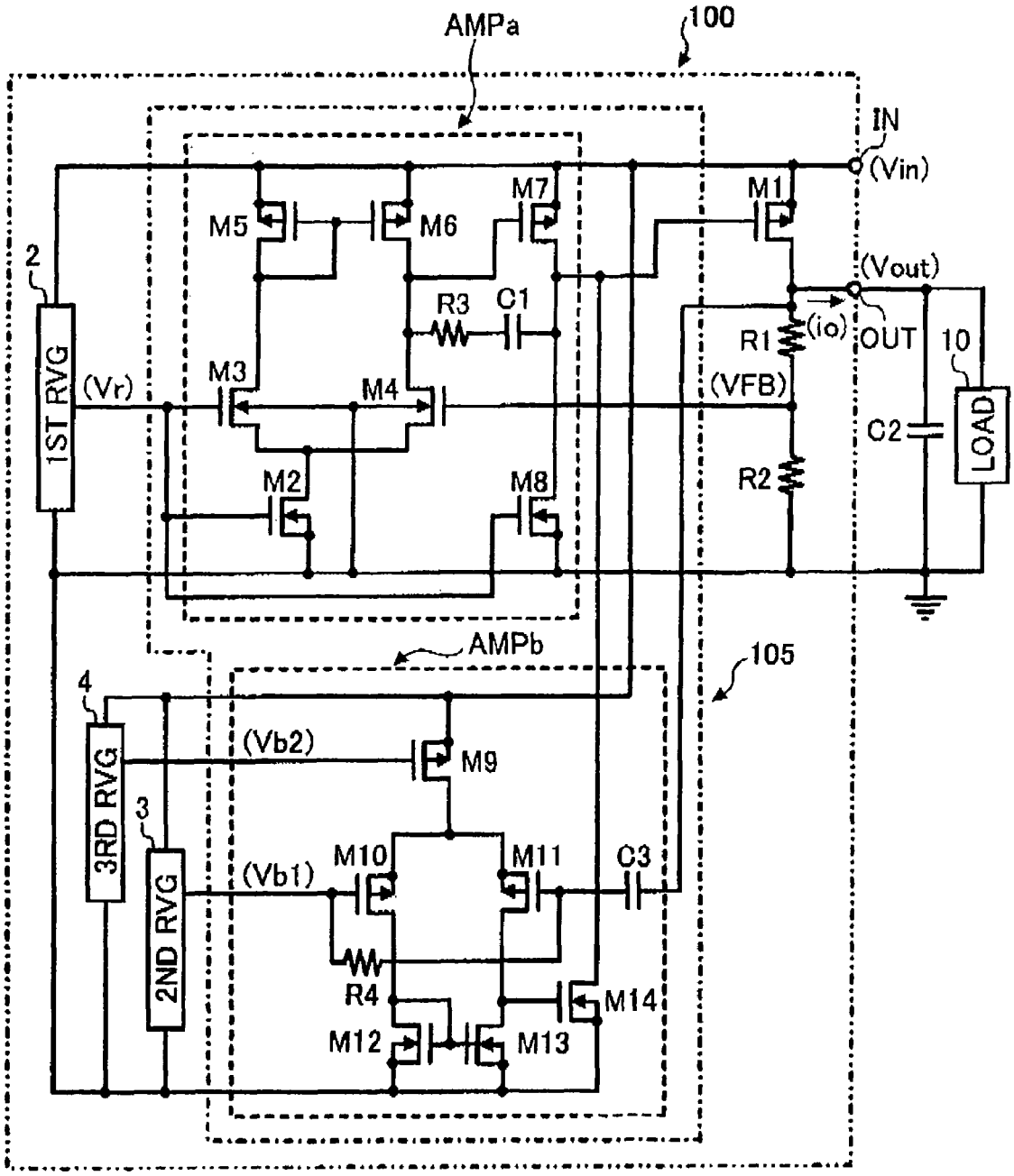
FIG. 1 PRIOR ART
FIG. 1 is a circuit diagram of an exemplary background constant voltage circuit.
Figure 2:
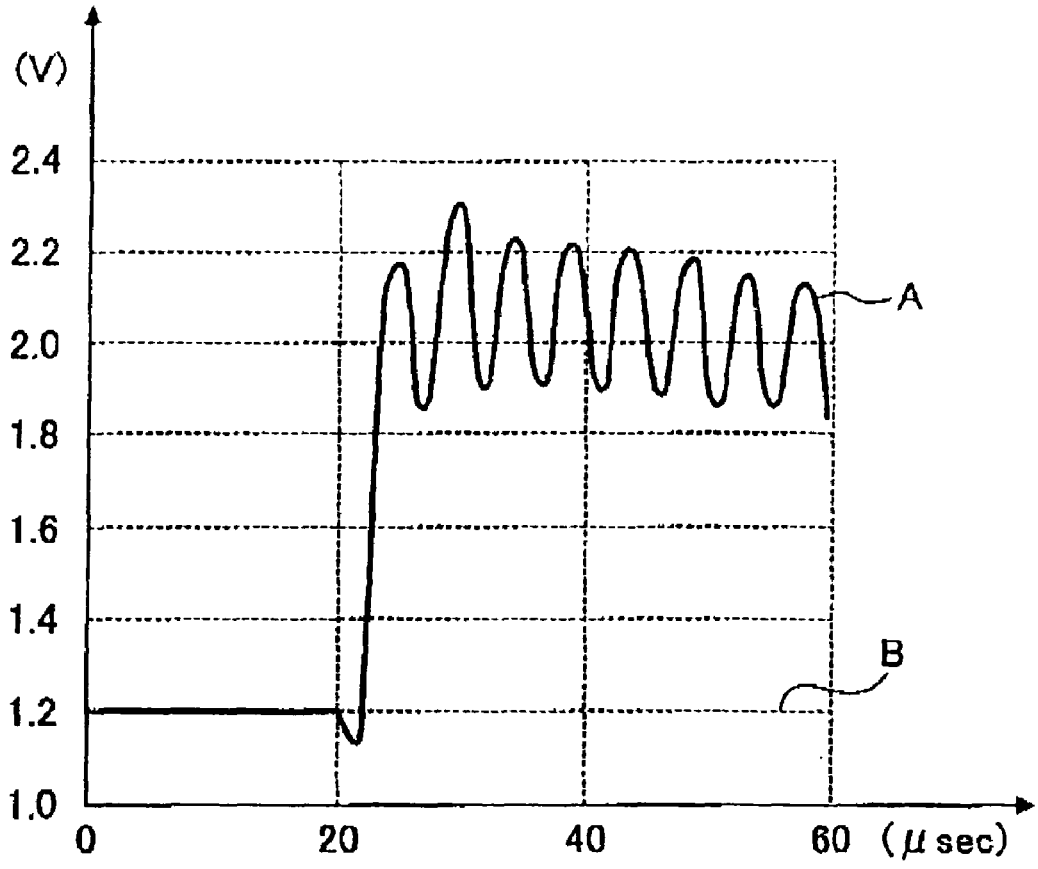
FIG. 2 PRIOR ART
FIG. 2 is a graph showing an exemplary response characteristic of the background constant voltage circuit of FIG. 1 in response to a load fluctuation.
Figure 3:
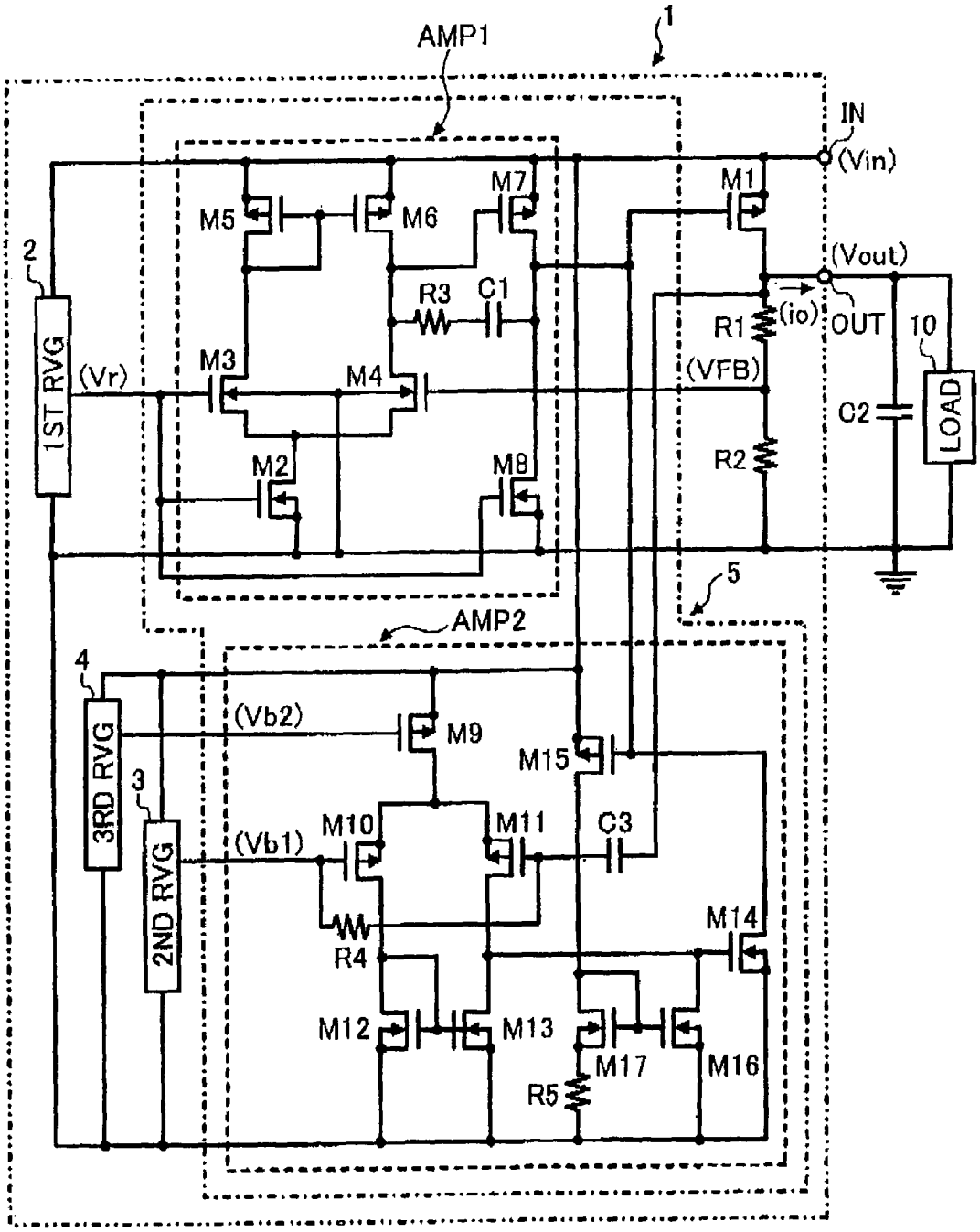
FIG. 3 is a circuit diagram of an exemplary constant voltage circuit according to an exemplary embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, a constant voltage circuit 1 according to an example embodiment of the present invention is explained. In FIG. 3, the constant voltage circuit 1 generates a predetermined constant voltage based on an input voltage Vin received through an input terminal IN, and outputs the predetermined constant voltage as an output voltage Vout through an output terminal OUT. A load 10 and a capacitor C2 are connected in parallel between the output terminal OUT and a ground.

As illustrated in FIG. 3, the constant voltage circuit 1 includes a first reference voltage generator (1st RVG) 2, a second reference voltage generator (2nd RVG) 3, and a third reference voltage generator (3rd RVG) 4. The first reference voltage generator 2 generates and outputs a predetermined reference voltage Vr. The second reference voltage generator 3 generates and outputs a predetermined reference voltage Vb1. The third reference voltage generator 4 generates and outputs a predetermined bias voltage Vb2. The constant voltage circuit 100 further includes resistors R1 and R2, an output transistor M1, and an error amplifying circuit 5. The resistors R1 and R2 divide the output voltage Vout to generate a divided voltage VFB. The output transistor M1 includes a P-MOS (P-type metal oxide semiconductor) transistor which, based on an input signal to a gate thereof, controls a current io flowing through an output terminal OUT. The error amplifying circuit 5 controls an operation of the output transistor M1 such that the divided voltage VFB is equalized to the reference voltage Vr. The first and second reference voltage generators 2 and 3 serve as a reference voltage generating circuit unit, and the resistors R1 and R2 serve as an output voltage detecting circuit unit.

The error amplifying circuit 5 includes first and second error amplifiers AMP1 and AMP2. The first error amplifier AMP1 has a non-inverse input terminal to which the reference voltage Vr is input and an inverse input terminal to which the divided voltage VFB is input. The second error amplifier AMP2 has a non-inverse input terminal to which the reference voltage Vb1 is input and an inverse input terminal to which the output voltage Vout is input. Each of the first and second error amplifiers AMPa and AMPb outputs a signal for controlling the operation of the output transistor M1 so as to control the output voltage Vout.

The output transistor M1 is connected between the input terminal IN and the output terminal OUT and to an output point of each one of the first and second error amplifiers AMP1 and AMP2. More specifically, the source of the output transistor M1 is connected to the input terminal IN, the drain thereof is connected to the output terminal OUT, and the base thereof is connected to the first and second error amplifiers AMP1 and AMP2. The resistors R1 and R2 are connected in series between the output terminal OUT and a ground voltage, and a divided voltage VFB is output from a connection point between the resistors R1 and R2.

The first error amplifier AMP1 includes a N-MOS transistors M2, M3, M4, and M8, P-MOS transistors M5, M6, and M7, a capacitor C1, and a resistor R3. The second error amplifier AMP2 includes P-MOS transistors M9, M10, M11, and M15, N-MOS transistors M12, M13, M14, M16, and M17, a capacitor C3, and resistors R4 and R5.

In the first error amplifier AMP1, the N-MOS transistors M2-M4, M8, P-MOS transistors M5-M7, the resistor R3, and the capacitor C1 together form an error amplifying circuit. Also, in the second error amplifier AMP2, the P-MOS transistors M9-M11, the N-MOS transistors M12 and M13 together form a differential amplifying circuit. Further, the N-MOS transistor M14 may be referred to as a control transistor. The resistor R4 may be referred to as a fixed resistor. The P-MOS transistor M15 may be referred to as a proportionality current generating circuit. The coupling capacitor C3 may be referred to as a capacitor.

In the first error amplifier AMP1, the N-MOS transistors M3 and M4 form a differential pair, and the P-MOS transistors M5 and M6 form a current mirror circuit operating as a load against the differential pair of the N-MOS transistors M3 and M4. In the P-MOS transistors M5 and M6, the sources are connected to the input terminal IN, and the gates are connected to each other and further connected to the drain of the P-MOS transistor M5. The drain of the P-MOS transistor M5 is connected to the drain of the N-MOS transistor M3, and the drain of the P-MOS transistor M6 is connected to the drain of the N-MOS transistor M4. As for the N-MOS transistors M3 and M4, the sources are connected to each other and to the source of the N-MOS transistor M2 of which drain is connected to the ground. The first reference voltage generator 2 is configured to operate using the input voltage Vin as a power and to supply the reference voltage Vr to the N-MOS transistors M2 and M3. The N-MOS transistor M2 operates as a constant current source. In addition, the divided voltage VFB is applied to the gate of the N-MOS transistor M4.

The P-MOS transistor M7 and the N-MOS transistor M8 are connected in series between the input terminal IN and the ground, and the connection point between the P-MOS transistor M7 and the N-MOS transistor M8 provides an output point of the first error amplifier AMP1 which is connected to the gate of the output transistor M1. The gate of the P-MOS transistor M7 is connected to a connection point between the P-MOS transistor M6 and the N-MOS transistor M4. The N-MOS transistor M8 is applied the reference voltage Vr at the gate thereof so as to operate as a constant current source. The capacitor C1 and the resistor R3 operating as a compensator for changes in frequency are connected between the two connection points between the P-MOS transistor M6 and the N-MOS transistor M4 and between the P-MOS transistor M7 and the N-MOS transistor M8.

In the second error amplifier AMP2, the P-MOS transistors M10 and M11 form a differential pair, and the N-MOS transistors M12 and M13 form a current mirror circuit operating as a load for the differential pair of the P-MOS transistors M10 and M11. In the connections of the N-MOS transistors M12 and M13, the sources thereof are coupled to the ground voltage, the gates thereof are coupled to each other, and the connection point of the gates is connected to the drain of the N-MOS transistor M12. Also, the drain of the N-MOS transistor M12 is connected to the drain of the P-MOS transistor M10, and the drain of the N-MOS transistor M13 is connected to the drain of the P-MOS transistor M11. The sources of the P-MOS transistors M10 and M11 are connected to each other, and the connection point between them is coupled to the source of the P-MOS transistor M9 of which drain is coupled to the input terminal IN.

The second and third-reference voltage generators 3 and 4 operate by using the input voltage Vin as a power, and supplies the bias voltage Vb2 to the gate of the P-MOS transistor M9 and the reference voltage Vb1 to the gate of the P-MOS transistor M10. The P-MOS transistor M9 operates as a constant current source. The capacitor C3 is connected between the gate of the P-MOS transistor M11 and the output terminal OUT. Also, the reference voltage Vb1 is applied to the connection point between the gate of the P-MOS transistor M11 and the capacitor C3, via the resistor R4. The N-MOS transistor M14 is connected between the gate of the transistor M1 and the ground voltage. The gate of the N-MOS transistor M14 is connected to the connection point between the P-MOS transistor M11 and the N-MOS transistor M13, and the drain of the N-MOS transistor M14 provides an output terminal of the second error amplifier AMP2.

The N-MOS transistor M16 is connected between the gate of the N-MOS transistor M14 and the ground voltage. The P-MOS transistor M15, the N-MOS transistor M17, and the resistor R5 are connected in series between the input voltage Vin and the ground voltage. The N-MOS transistors M16 and M17 and the resistor R5 form a current mirror circuit. The gates of the N-MOS transistors M16 and M17 are connected to each other, and the connection point between them is connected to the drain of the N-MOS transistor M17. The gate of the P-MOS transistor M15 is connected to the gate of the output transistor M1.

The first error amplifier AMP1 having the above-described structure is designed to minimize a drain current of the N-MOS transistor M2, operating as a constant current source, to maximize a gain of the direct current. Thereby, the first error amplifier AMP1 has an improvement in a direct current property. On the other hand, the second error amplifier AMP2 can selectively amplify, among other elements, an alternating current element of the output voltage Vout. This is because the gate of the P-MOS transistor M11, serving as an input port, is connected to the output terminal OUT via the capacitor C3 operating as a coupling capacitor.

The second error amplifier AMP2 having the above-described structure is designed to maximize the drain current of the P-MOS transistor M9, operating as a constant current source, to perform a high-speed operation. Accordingly, the second error amplifier AMP2 is capable of quickly increasing the output voltage Vout in response to a steep drop of the output voltage Vout due to, in particular, a sudden increase of the output current io by quickly executing the control operation for a predetermined time period on the output transistor M1 upon the steep drop of the output voltage Vout.

Operations of the first and second error amplifiers AMP1 and AMP2 are further explained below in more details, in particular for a case when the current flowing through the load 10 is rapidly increased and, as a result, the output voltage Vout is decreased at a speed faster than a predetermined speed.

Since the first error amplifier AMP1 has a relatively low response speed, it takes a relatively long time for the first error amplifier AMP1 to make the output transistor M1 increase the output current in response to a sharp drop of the output voltage Vout. In contrast to it, the second error amplifier AMP2 has a relatively high response speed and can quickly make the output transistor M1 increase the output current in response to a sharp drop of the output voltage Vout. Therefore, in this embodiment, the second error amplifier AMP2 is configured to control the output transistor M1 to increase the output current when the output voltage Vout is suddenly dropped.

In the second error amplifier AMP2, at a steep drop of the output voltage Vout, the gate voltage of the P-MOS transistor M11 is decreased through the capacitor C3, the drain current of the P-MOS transistor M11 is increased, and the gate voltage of the N-MOS transistor M14 is increased. As a consequence, the drain current of the N-MOS transistor M14 is increased, the gate voltage of the transistor M1 is lowered, and the drain current of the output transistor M1 is increased. Accordingly, the output current io is increased so as to suppress the reduction of the output voltage Vout.

The gate voltage of the P-MOS transistor M11 is substantially equalized to the reference voltage Vb1 in a predetermined time period determined by a time constant of the resistor R4 and the capacitor C3 when the output voltage Vr is rapidly dropped. Greater the time constant of the resistor R4 and the capacitor C3, better the responsiveness of the second error amplifier AMP2 relative to the variations of the output voltage Vout. Conversely, smaller the time constant of the resistor R4 and the capacitor C3, worse the responsiveness of the second error amplifier AMP2 relative to the variations of the output voltage Vout. Therefore, it may be preferable to define the value of the resistor R4 as 2 MΩ and the capacitance of the capacitor C3 as 5 pF, in consideration of environmental factors such as an area of circuit layout, for example.

In this embodiment, at least one of the P-MOS transistors M10 and M11 is provided with an offset so that the P-MOS transistor M10 generates a relatively large output current while the P-MOS transistor M11 generates an extremely small output current when a common voltage is applied to their gates. To make this happen, the P-MOS transistors M10 and M11 are preferably configured to have transistor sizes of W/L=40 μm/2 μm and W/L=32 μm/2 μm, respectively, where W is a gate width and L is a gate length. In other words, a ratio of transistor size between the P-MOS transistors M10 and M11 may preferably be around 10:8.

As described above, the second error amplifier AMP2 does control the output transistor M1 with the N-MOS transistor M14 during a regular operation, that is, an operation having no rapid drop of the output voltage Vout. Therefore, the second error amplifier AMP2 does not affect the control operation performed by the first error amplifier AMP1 relative to the output transistor M1.

In this embodiment, the P-MOS transistor M15 and the output transistor M1 are connected each other such that their sources and gates are commonly coupled. The P-MOS transistor M15, however, has a size far smaller than the output transistor M1 and accordingly produces the drain current in proportion to but far smaller than the drain current of the output transistor M1.

When the output voltage Vout is suddenly dropped, the N-MOS transistor M14 is immediately turned on and decreases the gate voltage of the output transistor M1, so as to cause the output transistor M1 to increase the drain current.

At this time, the drain current of the P-MOS transistor M15 is also increased at a substantially same increase ratio of the drain current of the output transistor M1. The drain current of the P-MOS transistor M15 is input to the current mirror circuit including the N-MOS transistors M16 and M17 and the resistor R5. The drain current of the P-MOS transistor M15 is equal to the drain current of the N-MOS transistor M17 and is therefore flowing through the resistor R5, resulting in a voltage drop across the resistor R5.

The gate voltage of the N-MOS transistor M16 is equal to the sum total of the gate-source voltage of the N-MOS transistor M17 and the voltage drop of the resistor R5. Based on this, the drain current of the N-MOS transistor M16 is greater than the drain current of the N-MOS transistor M17 if the N-MOS transistors M16 and M17 are of substantially identical characteristics. The ratio of the drain currents of the N-MOS transistors M16 and M17 can be determined by the resistor R5.

Figure 4:
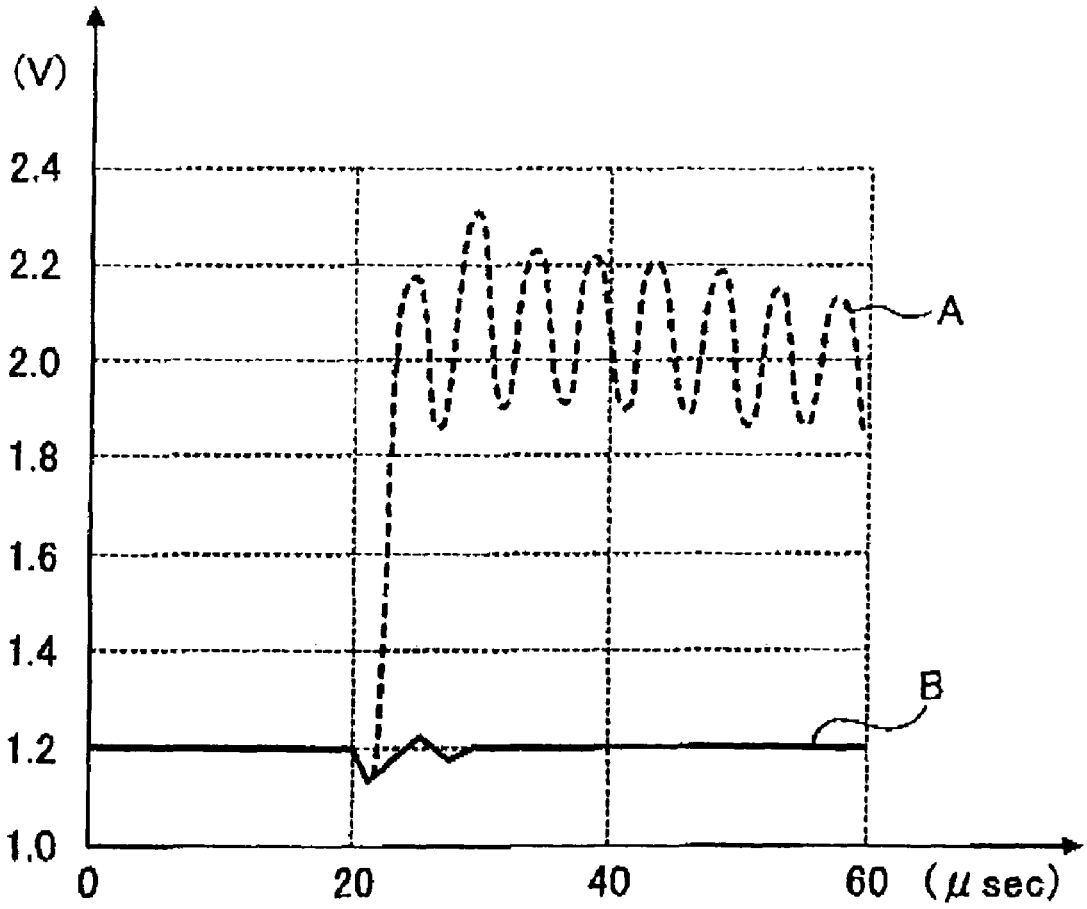
FIG. 4 is a graph showing an exemplary response characteristic of the constant voltage circuit of FIG. 3 in response to a load fluctuation.

When the N-MOS transistor M16 is turned on and allows a current flow, it reduces impedance thereof and accordingly causes the N-MOS transistor M14 to decrease the gate voltage thereof to suppress a reduction of the drain voltage of the N-MOS transistor M14. In other words, when this happens, the gain of the second error amplifier AMP2 is lowered. As a result, the output voltage Vout is protected from being overshot, as indicated by a ghost line A in FIG. 4. More specifically, when the constant voltage circuit 1 has a rated output voltage of 1.2 volts, for example, it can suppress the variations of the output voltage Vout within the order of approximately 50 mV, as indicated by a solid line B in FIG. 4, thereby obtaining the output voltage in a constantly stable manner.

The N-MOS transistor M16 has variations in temperature characteristics and a threshold voltage, and the resistor R5 also has variations in temperature characteristics and a resistor value. However, at least the variations of temperature characteristics and a threshold voltage of the N-MOS transistor M16 can be canceled by the N-MOS transistor M17. In addition, by the N-MOS transistor M17, a conversion of the drain current of the P-MOS transistor M15 into voltage can be made linearly. That is, smaller the drain current of the P-MOS transistor M15, greater a rate of such current-to-voltage conversion. Greater the drain current of the P-MOS transistor M15, smaller the rate of the current-to-voltage conversion. Therefore, the P-MOS transistor M15 produces the current to some extent when the constant voltage circuit 1 is in operation, resulting in a reduction of the current-to-voltage conversion rate.

As a result, the gate voltage of the N-MOS transistor M16 gently varies when such variation is greater than a predetermined value. Therefore, with this structure, the constant voltage circuit 1 can operate more stably than a case in which the N-MOS transistor M17 is eliminated and the gate of the N-MOS transistor M16 is connected to the connection point between the P-MOS transistor M15 and the resistor R5.

It may be possible to have a structure in which the resistor R5 is eliminated and the source of the N-MOS transistor M17 is grounded. In this case, the N-MOS transistor M16 is needed to have a transistor size W/L greater than the N-MOS transistor M17 so that the N-MOS transistor M16 can reduce the gate voltage of the N-MOS transistor M14.

Figure 5:
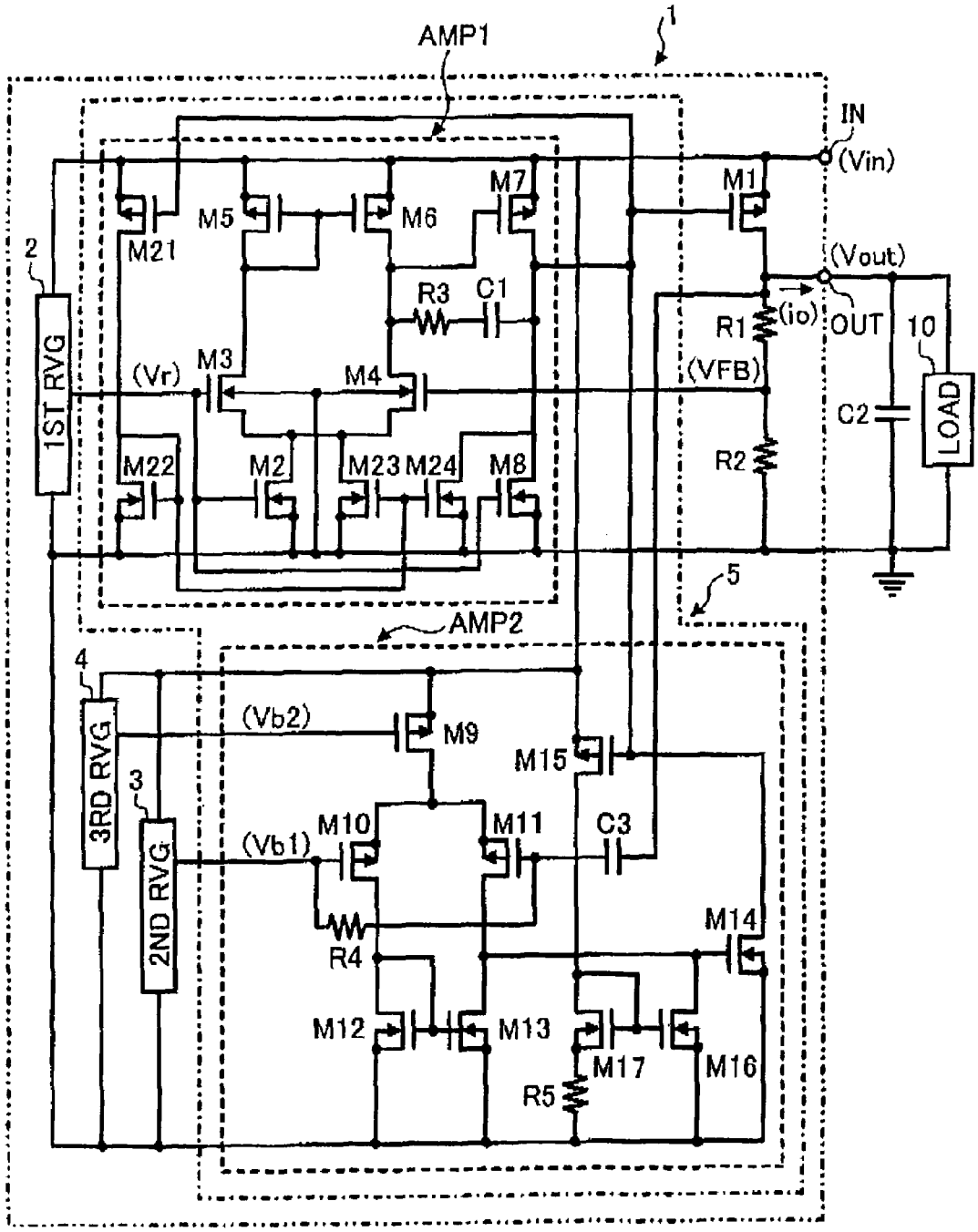
FIG. 5 is a circuit diagram of another exemplary constant voltage circuit according to another embodiment.

Referring to FIG. 5, a constant voltage circuit 1*a* according to another embodiment of the present invention is explained. The constant voltage circuit 1*a* is configured to vary the bias current of the first error amplifier AMP1 in accordance with the output current io, which is a difference of feature from the constant voltage circuit 1 shown in FIG. 3. More specifically, from the constituent element viewpoint, the constant voltage circuit 1*a* of FIG. 5 is similar to the constant voltage circuit 1 of FIG. 3, except for additional N-MOS transistors M22, M23, and M24, and a P-MOS transistor M21. In FIG. 5, an error amplifier and an error amplifying circuit are provided with reference numerals AMP1*a* and 5*a*, respectively, due to the above-mentioned difference in the constituent elements.

In the constant voltage circuit 1*a* of FIG. 5, the P-MOS transistor M21 and the N-MOS transistors M22-M24 for respective bias current adjusting circuits. Specifically, the P-MOS transistor M21 and the N-MOS transistor M22 are connected in series between the input terminal IN and the ground. The gate of the P-MOS transistor M21 is connected to the gate of the output transistor M1. Also, the N-MOS transistors M22-M24 form a current mirror circuit. Specifically, the gates of the N-MOS transistors M22-M24 are connected to each other, and the connection point thereof is connected to the drain of the N-MOS transistor M22. The N-MOS transistor M23 is connected in parallel with the N-MOS transistor M2, and the N-MOS transistor M24 is connected to in parallel with the N-MOS transistor M8.

In the constant voltage circuit 1*a* having the structure as described above, the P-MOS transistor M21 has a transistor size W/L in the range of from 1/1000 to 1/10000 of the output transistor M1, and produces a current in proportional to the output current io. The current mirror circuit made of the N-MOS transistors M22-M24 produces a current in proportional to the output current io generated by the output transistor M1. This current produced by the current mirror circuit is applied as a bias current via the N-MOS transistor M23 to the N-MOS transistors M3 and M4 which form a differential pair. At the same time, this current produced by the mirror circuit is applied to the P-MOS transistor M7 as a bias current via the N-MOS transistor M24.

With the above-described structure, the first error amplifier AMP1*a* has two bias current sources to a differential pair of the N-MOS transistors M3 and M4. That is, one source is the N-MOS transistor M2 which supplies a predetermined bias current, and another source is a group of transistors including the P-MOS transistor M21 and the N-MOS transistors M22 and M23 which supply the bias current in proportion to the output current io, as described above. Further, the first error amplifier AMP1*a* has two bias current sources to the P-MOS transistor M7 serving as an amplifying stage. That is, one source is the N-MOS transistor M8 which supplies a predetermined bias current, and another source is a group of transistors including the P-MOS transistor M21 and the N-MOS transistors M22 and M24 which supply the bias current in proportion to the output current io, as described above.

Therefore, the constant voltage circuit 1*a* can produce a substantially similar effect produced by the constant voltage circuit 1 of FIG. 3. More specifically, the first error amplifier AMP1*a* can quickly respond to the changes of the output voltage Vout in accordance with an increase of the output current io. In addition to it, the first error amplifier AMP1*a* has the following feature. The first error amplifier AMP1*a* is configured to produce a bias current relatively smaller in order to suppress the electric consumption at a time without a load. Accordingly, the consumption current by the first error amplifier AMP1*a* is a few μA at a time with a relatively light load. Such a small consumption current causes a reduction of response speed of the first error amplifier AMP1*a*. When the condition is changed from substantially no load to a relatively heavy load, for example, the first error amplifier AMP1*a* may have a delay in a rise by a time of increasing the bias current. However, the combination of the first error amplifier AMP1*a* with the second error amplifier AMP2 can achieve a high-speed rise while maintaining a relative low electric consumption.

In addition, the first error amplifier AMP1*a* can quickly respond to a load variation even with the output current io exceeding a predetermined value, e.g., 30 mA, at which the second error amplifier AMP2 is configured to forcibly stop its operation. This is because the first error amplifier AMP1*a* produces a bias to a certain extent when the output current io exceeds the predetermined current, e.g., 30 mA.

In this way, each of the constant voltage circuits 1 and 1*a* is configured to reduce the gain of the second error amplifier AMP2 in accordance with an increase of the drain current of the output transistor M1. This configuration can suppress an overshoot which may be produced with a relatively large sized capacitor serving as the coupling capacitor C3. Therefore, it becomes possible to use a relatively large sized capacitor for the coupling capacitor C3 so as to increase a sensitivity relative to changes of the output voltage Vout.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JPAP2005-107677 filed on Apr. 4, 2005 in the Japan Patent Office, the entire contents of which are incorporated by reference herein.

The invention claimed is:

1. A constant voltage circuit, comprising:

an output means for outputting a power with an output voltage and an output current to a load;

a first error amplification means configured to receive a first reference voltage and increase a response speed with respect to changes of the output voltage in accordance with an increase of the output current so as to control operations of the output means; and a second error amplification means, configured to receive a second reference voltage and a bias voltage, having a response speed faster than the first error amplification means with respect to changes of the output voltage, and configured to decrease a gain thereof in response to a drain current of the output means.

2. The constant voltage circuit according to claim 1, wherein the first error amplification means is configured to substantially equalize a proportional output voltage with the first reference voltage.

3. The constant voltage circuit according to claim 1, the second error amplification means further comprising:

a control means which controls the operations of the output transistor in response to a control signal input to a gate of the control transistor;

a differential amplification means having first and second input terminals, configured to receive the second reference voltage to the first input terminal and to control the control means to equalize a voltage input to the second input terminal with the second reference voltage;

a capacitive means connected between another input terminal of the differential amplification means and the output terminal;

a resistive means connected between the first and second input terminals of the differential amplification means; and a current mirror means including a transistor, configured to generate and output a current in proportion to the output current from the proportion current generator means, and to change an impedance of the transistor means so as to control a voltage of the control means to control the operations of the control means to control the gain of the second error amplification means.

4. A constant voltage circuit having an input receiving means for receiving an input voltage and an output means for output an output voltage through a voltage conversion means based on the input voltage, comprising:

an output transistor which allows a current to flow from the input receiving means to the output means in accordance with a control signal input to the output transistor;

a voltage generator means configured to generate and output first and second reference voltages;

a voltage detection means configured to detect a voltage output from the output means and to generate and output a proportional voltage in proportion to the voltage detected; and error amplification means configured to control the output transistor to equalize the proportional voltage substantially with the first reference voltage, the error amplification means including:

a first error amplification means configured operations of the output transistor so as to equalize the proportional voltage substantially with the first reference voltage, and a second error amplification means having a faster response speed than the first error amplification means relative to changes of the output voltage output from the output means and configured to cause the output transistor to increase an output current for a predetermined time period in response to a rapid decrease of the output voltage output from the output means at a speed faster than a predetermined speed, the second error amplification means including:

a control means which controls the operations of the output transistor in response to a control signal input to the control means, a differential amplifying means having first and second input terminals, configured to receive the second reference voltage to the first input terminal and to control the control means to equalize a voltage input to the second input terminal with the second reference voltage, a capacitive means connected between another input terminal of the differential amplifying means and the output means, a resistive means connected between the first and second input terminals of the differential amplifying means, a proportion current generator means configured to generate and output a current in proportion to a current output from the output transistor, and a current mirror means configured to generate and output a current in proportion to the output current from the proportion current generator means, and to change an impedance of a output-side transistor means in accordance with an output current from the proportion current generator means so as to control a voltage applied to the control means to control a gain of the second error amplification means.

5. The constant voltage circuit according to claim 4, wherein the current mirror means is further configured to control the operations of the control means such that the gain of the second error amplification means is decreased in response to an increase of an output current from the proportion current generator means.

6. The constant voltage circuit according to claim 4, wherein the current mirror means includes:

an input-sided transistor arranged to receive the output current from the proportion current generator means;

a first resistive means connected in series to the input-sided transistor; and the output-sided transistor arranged to control a voltage of the control means.

7. The constant voltage circuit according to claim 6, wherein the input-sided and output-sided transistors are MOS transistors.

8. The constant voltage circuit according to claim 4, wherein the current mirror means includes:

an input-sided transistor arranged to receive the output current from the proportion current generator means; and an output-sided transistor arranged to control the voltage of the control means.

9. The constant voltage circuit according to claim 4, wherein the first error amplification means includes:

an error amplification means configured to control the operations of the output transistor such that the proportional current output from the output voltage detection means circuit is equalized substantially to the first reference voltage; and a bias current adjusting means configured to adjust a bias current of the error amplification means in accordance with a current output from the output transistor.

10. The constant voltage circuit according to claim 9, wherein the bias current adjusting means is configured to increase a response speed of the error amplifying means relative to changes of the voltage at the output means in accordance with an increase of the current output from the output transistor.

* * * * *